US010132310B2

(12) United States Patent
Chou

(10) Patent No.: US 10,132,310 B2
(45) Date of Patent: Nov. 20, 2018

(54) AIR COMPRESSOR

(71) Applicant: Wen-San Chou, Tainan (TW)

(72) Inventor: Wen-San Chou, Tainan (TW)

( * ) Notice: Subject to any disclaimer, the term of this patent is extended or adjusted under 35 U.S.C. 154(b) by 447 days.

(21) Appl. No.: 15/018,312

(22) Filed: Feb. 8, 2016

(65) Prior Publication Data

US 2016/0258431 A1 Sep. 8, 2016

(30) Foreign Application Priority Data

Mar. 3, 2015 (TW) ..... 104106740 A

(51) Int. Cl.

| | |
|---|---|
| ***F04B 49/22*** | (2006.01) |
| ***F04B 39/12*** | (2006.01) |
| ***F04B 35/04*** | (2006.01) |
| ***F04B 39/10*** | (2006.01) |
| ***F04B 39/14*** | (2006.01) |

(52) U.S. Cl.

CPC ..... *F04B 49/22* (2013.01); *F04B 35/04* (2013.01); *F04B 39/1073* (2013.01); *F04B 39/121* (2013.01); *F04B 39/125* (2013.01); *F04B 39/14* (2013.01)

(58) Field of Classification Search

CPC ..... F04B 35/04; F04B 39/121; F04B 49/22; F04B 39/125; F04B 39/14; F04B 39/1073; F04B 39/122

See application file for complete search history.

(56) References Cited

U.S. PATENT DOCUMENTS

| | | | | |
|---|---|---|---|---|
| 2007/0212242 | A1* | 9/2007 | Chen | F04B 39/1066 417/571 |
| 2008/0145245 | A1* | 6/2008 | Chou | B29C 73/166 417/415 |
| 2009/0028733 | A1* | 1/2009 | Duwel | F04B 39/1066 417/546 |
| 2012/0121443 | A1* | 5/2012 | Chou | F04B 35/04 417/297 |
| 2013/0011283 | A1* | 1/2013 | Chou | F04B 35/04 417/437 |
| 2014/0112812 | A1* | 4/2014 | Takemi | F04B 39/121 417/571 |
| 2015/0316044 | A1* | 11/2015 | Lifson | F04B 27/1009 417/437 |

* cited by examiner

*Primary Examiner* — Dominick L Plakkoottam

(57) ABSTRACT

An improved motor includes a cylinder defining multiple exit holes of different diameters, which are respectively controlled by a resilient sheet having multiple branches to communicate with an air storage container. In operation, when a piston body conducts reciprocating motion in the cylinder, the compressed air produced in the cylinder can quickly enter the air storage container. The branches of the resilient sheet are subjected to different back force resulting from the compressed air in the air storage container, wherein the smallest branch of the resilient sheet is subjected to a smallest back force, so that the compressed air produced in the cylinder can enter the air storage container more easily through the smallest exit hole, so that the piston body can conduct reciprocating motion more smoothly and thus the performance of the air compressor can be increased.

7 Claims, 8 Drawing Sheets

AIR COMPRESSOR

TECHNICAL FIELD OF THE INVENTION

The present invention relates to an improved air compressor and, more particularly, to an air compressor which includes a cylinder defining a plurality of exit holes having different diameters, whereby the flow rate of compressed air entering the inner space of an air storage container can be significantly increased. Furthermore, since a branch of a resilient sheet corresponding to an exit hole having a smaller diameter will experience a smaller back force from the compressed air stored in the air storage container, so that, at a later stage of operation, the exit hole having a smaller diameter allows the compressed air to enter the air storage container more easily; therefore, the piston body can move in the cylinder more smoothly, and the efficiency of inflating an object can be increased.

DESCRIPTION OF THE PRIOR ART

Currently, air compressors basically has a cylinder which allows a piston body to conduct reciprocating motion therein to produce compressed air which can overcome a valve mechanism, so that the compressed air can flow through an exit hole of the cylinder to enter the inner space of an air storage container or an air tank. The air storage container is provided with outlets for delivering the compressed air to an object to be inflated.

However, in conventional air compressors, there is only one exit hole defined at the cylinder for communicating with the air storage container. The exit hole of the cylinder is controlled by a valve mechanism, which generally includes a plug and a compression spring, so that the exit hole can be opened or closed properly according to the pressure of the compressed air. In operation, the compressed air produced in the cylinder can overcome the compressive force of the compression spring to enter the inner space of the air compressor. However, the compressed air stored in the air storage container can exert a back force on the plug, thus restraining the plug being moved away from the exit hole. As a result, the piston body, which conducts reciprocating motion in the cylinder, will be subjected to greater resistance. Therefore, the piston body may not move smoothly in the cylinder, and thus the speed of inflating an object will become slow. Furthermore, the motor of the air compressor will probably overheat and thus the performance of the motor may decrease. Even worse, the motor may be under the risk of burning out.

In view of the foregoing, the applicant intends to develop an improved air compressor which can solve the shortcomings of conventional air compressors.

SUMMARY OF THE INVENTION

One object of the present invention is to provide an improved air compressor, wherein the cylinder of the air compressor defines a plurality of exit holes, through which the compressed air produced in the cylinder can enter the inner space of an air storage container, whereby the flow rate of the compressed air entering the air storage container can be significantly increased.

According to one feature of the present invention, the exit holes have different diameters, wherein, at a later stage of operation, one branch of a resilient sheet corresponding to an exit hole with a smallest diameter will be subjected to a smallest back force; namely, the branch of the resilient sheet can be pushed away from the corresponding exit hole more easily than the other branches of the resilient sheet being pushed away from their corresponding exit holes. Thus, at a later stage operation, the resistance of the piston body conducting reciprocating motion can be reduced, so that the piston body can move in the cylinder more smoothly, the load of the motor can be reduced, and the efficiency of inflating an object can be increased. Therefore, a lower-power motor can be used in the air compressor to quickly inflate an object.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
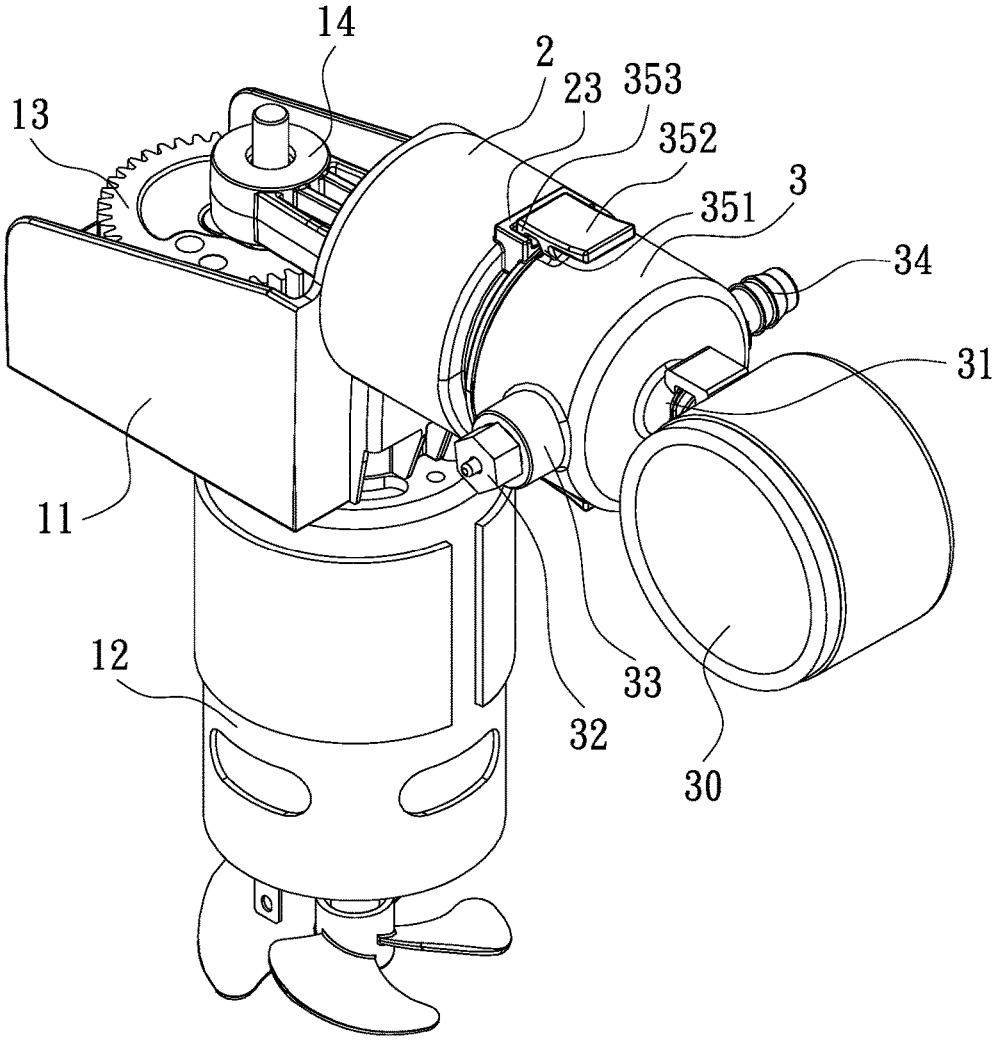
FIG. 1 shows a 3-dimensional view of an air compressor according to one embodiment of the present invention.

Referring to FIG. 1, an air compressor according to one embodiment of the present invention is shown, which generally comprises a main frame 11, a motor 12 mounted at the main frame 11, a cylinder 2 fitted with a piston body 14 and provided at the main frame 11, and an air storage container 3. The motor 12 can rotate a gear 13 to have the piston body 14 conduct reciprocating motion in the cylinder 2 to produce therein compressed air which is regulated to enter an inner space 36 of the air storage container 3 (see FIG. 7). The air storage container 3 is provided with one or more outlets. In this embodiment, outlets 31, 33, 34 are provided. As an example, the outlet 31 can be connected with a pressure gauge 30; the outlet 33 can be connected with a relief valve 32; the outlet 34 can be connected by a hose (not shown) to an object to be inflated.

Referring to FIGS. 2 through 5, the design of the cylinder 2 of the present invention is different from that of the cylinders of conventional air compressors, wherein the cylinder 2 defines at its top wall 21 a plurality of exit holes, which allows the compressed air to enter the inner space 36 of the air storage container 3. In this embodiment, there are three exit holes 4, 5, 6, which have different diameters (see FIG. 3). As shown, the exit hole 4 has a diameter of (X); the exit hole 5 has a diameter of (Y); the exit 6 has a diameter of (Z), wherein (X) is greater than (Y), and (Y) is greater than (Z). Furthermore, the cylinder 2 is provided with a tubular projection 22 on the top wall 21, wherein the tubular projection 22 has two opposite lugs 23, each of which has a flat segment 231. The cylinder 2 is provided with a valve mechanism for regulating the three exit holes 4, 5, 6 to open or close. In this embodiment, the valve mechanism includes a resilient sheet 7, three O-rings 41, 51, 61 respectively placed on the top wall 21 of the cylinder 2, around the exit holes 4, 5, 6 of the cylinder 2, and three compression springs 82, 83, 84 corresponding to three parts or branches of the resilient sheet 7. As shown, the resilient sheet 7 has a root 70 and three branches 72, 73, 74 extending from the root 70 and corresponding to the O-rings 41, 51, 61 or the exit holes 4, 5, 6. The O-ring 41 is placed around the exit hole 4; the O-ring 51 is placed around the exit hole 5; the O-ring 61 is placed around the exit hole 6. The root 70 of the resilient sheet 7 defines a positioning hole 71, which can be fitted with a positioning pin 24 formed on the top wall 21 of the cylinder 2 to have the resilient sheet 7 fixed on the top wall 21 of the cylinder 2. The branch 72 is placed on the O-ring 41. The branch 73 is placed on the O-ring 51. The branch 74 is placed on the O-ring 61. The branches 72, 73, 74 have coverage areas, which respectively match the dimensions of the exit holes 4, 5, 6, wherein a larger exit hole is covered by a larger branch of the resilient sheet 7. In this embodiment, the branch 72, which corresponds to the exit hole 4, has a coverage area of (A); the branch 73, which corresponds to the exit hole 5, has a coverage area of (B); the branch 74, which corresponds to the exit hole 6, has a coverage area of (C); wherein the relationship of A>B>C is fulfilled. The branches 72, 73, 74 can respectively seal the exit holes 4, 5, 6 (see also FIG. 4). First ends of the compression springs 82, 83, 84 are respectively urged against branches 72, 73, 74 of the resilient sheet 7 (see FIGS. 2 and 7). The air storage container 3 is provided at a bottom portion of its circumferential surface with two opposite resilient holders corresponding to the lugs 23 of the cylinder 2. Furthermore, in this embodiment, the air storage container 3 is provided at its inner surface with three columns 37, 38, 39 (the column 38 is not shown in FIG. 7). Each resilient holder has a fulcrum portion 351, a press portion 352, a first engagement portion 353, and a second engagement portion 354, wherein the fulcrum portion 351 extends outwardly from the bottom portion of the circumferential surface of the air storage container 3 and integrally formed between the press portion 352 and the first engagement portion 353; the second engagement portion 354 is formed at one end of the fulcrum portion 351, opposite to the first engagement portion 353. As such, the first engagement portion 353 can engage with one surface of the flat segment 231 of the corresponding lug 23 of the cylinder 2 (see FIGS. 6 and 7), while the second engagement portion 354 can engage with an opposite surface of the flat segment 231 of the corresponding lug 23 of the cylinder 2 so that the air storage container 3 can be detachably mounted to the cylinder 2 (see FIG. 1). A user may depress the press portions 352 of the two opposite resilient holders to allow the air storage container 3 to be released from the cylinder 2, so that repair or maintenance for the air compressor can be proceeded. Second ends of the compression springs 82, 83, 84 are respectively fitted around the columns 37, 38, 39 of the air storage container 3 (the column 38 is not shown in FIG. 7). The columns 37, 38, 39 of the air storage container 3 are respectively located slightly above the branches 72, 73, 74 of the resilient sheet 7 to limit movements of the branches 72, 73, 74 of the resilient sheet 7, so that the branches 72, 73, 74 can be prevented from elastic fatigue. The compression springs 82, 83, 84 can respectively urge the branches 72, 73, 74 of the resilient sheet 7 to press the O-rings 41, 51, 61 against the top wall 21 of the cylinder 2 to seal the exit holes 4, 5, 6.

Figure 6:
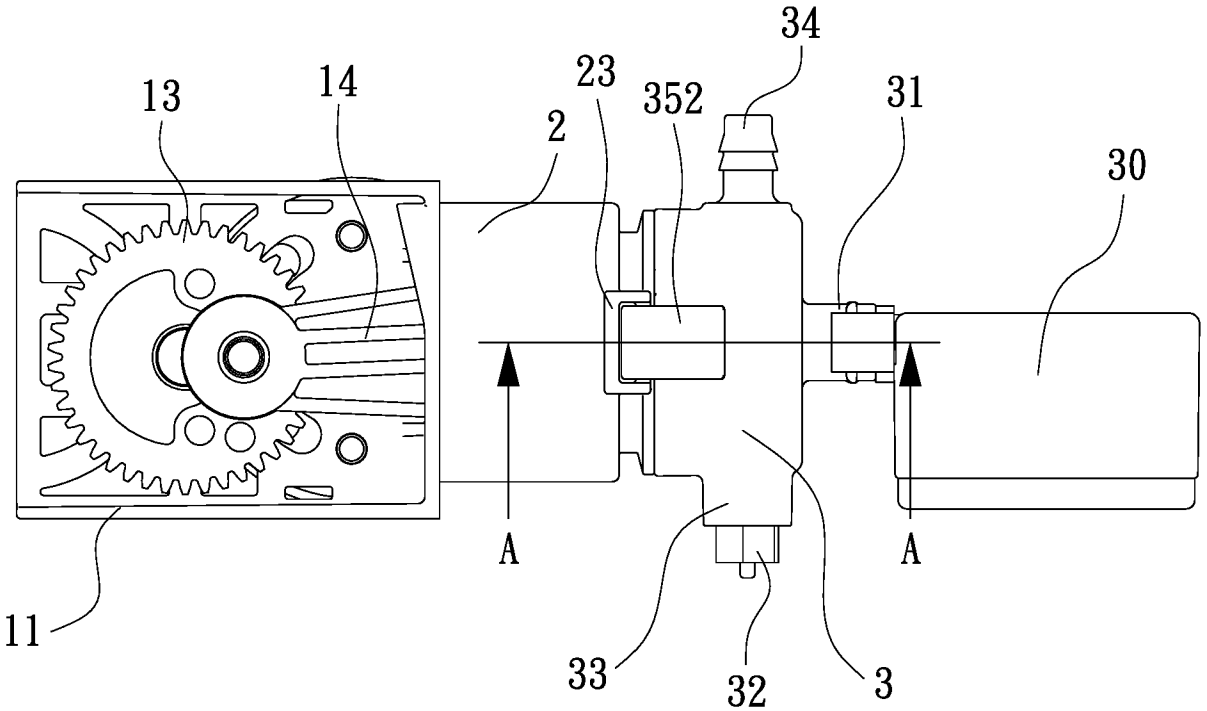
FIG. 6 shows a plan view of the air compressor, wherein a gear and a piston body used in the air compressor is manifested.
Figure 7:
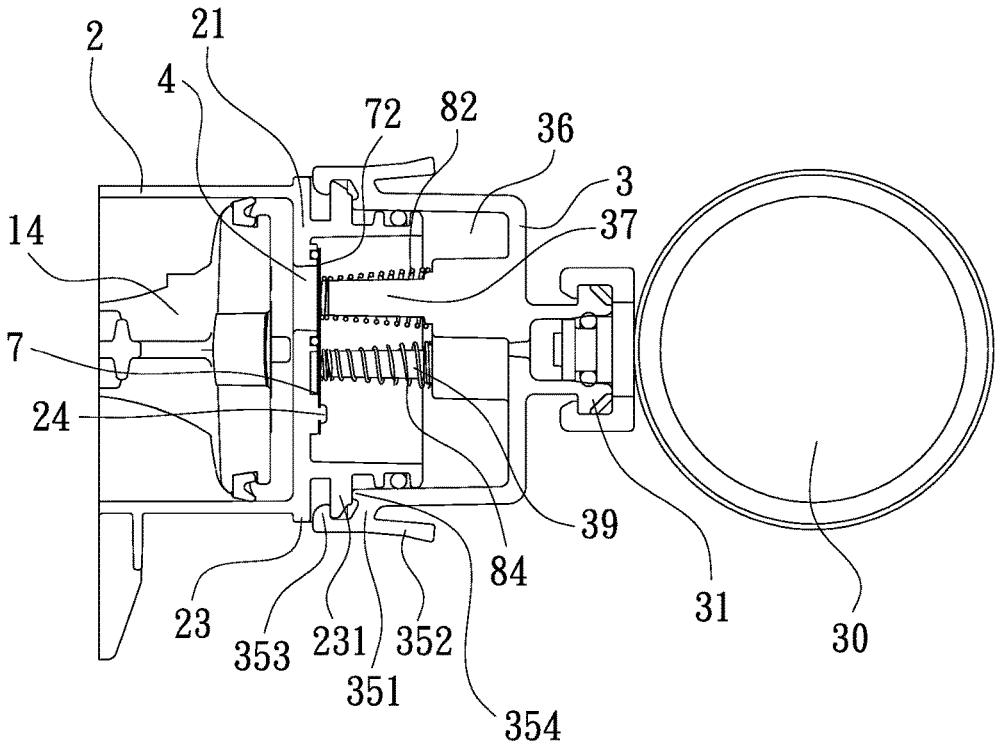
FIG. 7 shows a partially sectional view of the air compressor taken along line A-A in FIG. 6.

Referring to FIGS. 6 and 7, when the air compressor is started, the piston body 14 can be driven to conduct reciprocating motion in the cylinder 2 to produce therein compressed air, which can overcome the compressive force of the compression springs 82, 83, 84 to move the branches 72, 73, 74 of the resilient sheet 7 away from their corresponding exit holes 4, 5, 6, so that the compressed air can enter the inner space 36 of the air storage container 3. At an earlier stage of operation, the compressed air can enter the inner space 36 of the air storage container 3 simultaneously via the exits holes 4, 5, 6, so that the flow rate of the compressed air entering the air storage container 3 can be increased significantly. At a later stage of operation, since a large amount of compressed air has been stored in the inner space 36 of the air storage container 3, the stored compressed air can exert back forces on the branches 72, 73, 74 of the resilient sheet 7 so that they are further restrained. As a result, the piston body 14 will be subjected to greater resistance while it is conducting reciprocating motion.

However, due to the exit holes 4, 5, 6 and the corresponding branches 72, 73, 74 having different diameters, the branches 72, 73, 74 are subjected to different back forces. In this embodiment, since the branch 74 has a smallest coverage are, it will be subjected to a smallest back force among the branches; namely, the branch 74 can be pushed away from the exit hole 6 more easily than the other branches being pushed away their corresponding exit holes. Thus, at a later stage of operation, the motion resistance of the piston body 14 can be reduced, so that the piston body 14 can move in the cylinder 2 more smoothly. The load of the motor can be reduced. Thus, a lower-power motor can be used in the air compressor of the present invention to quickly inflate an object.

Figure 2:
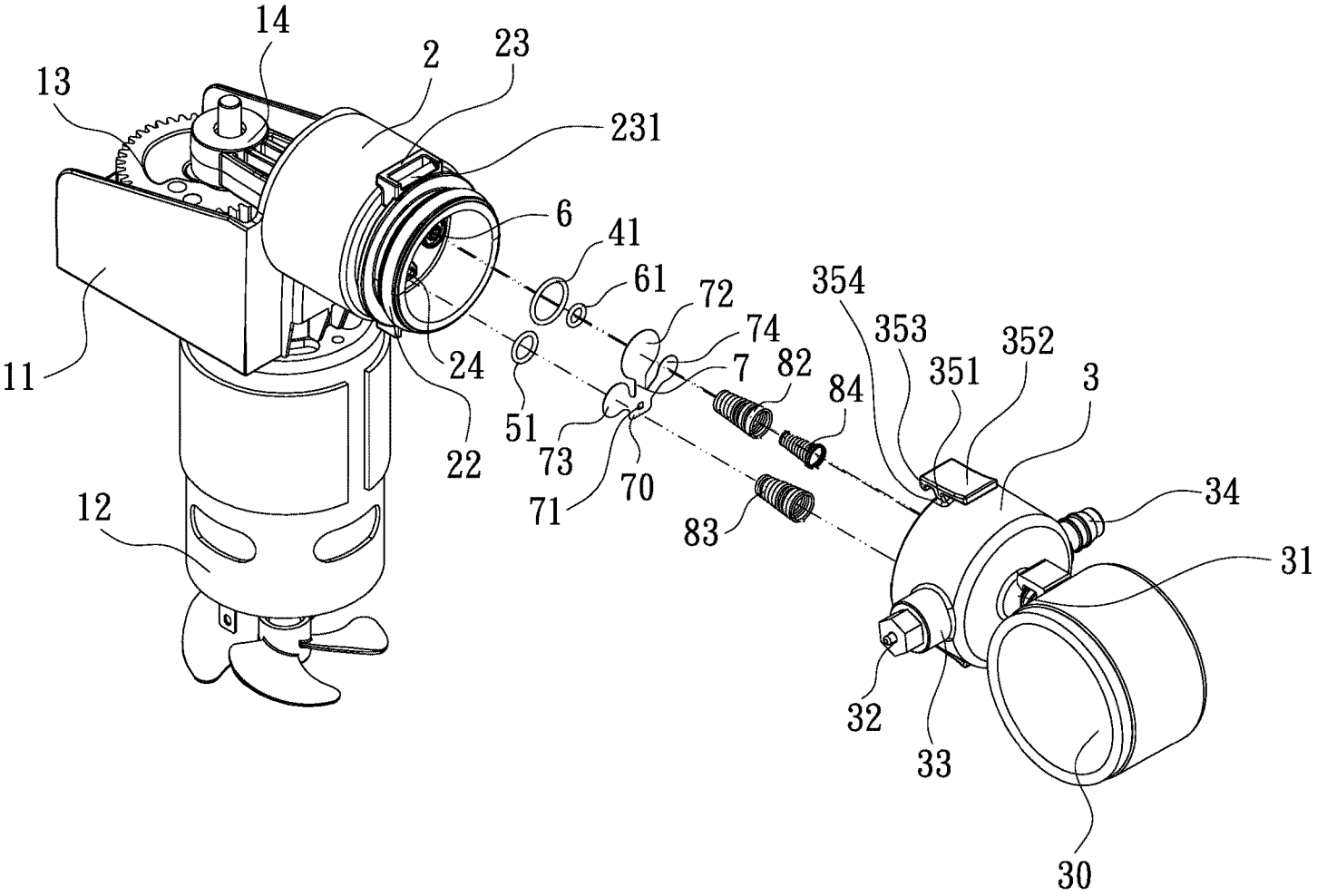
FIG. 2 shows an exploded view of the air compressor.
Figure 3:
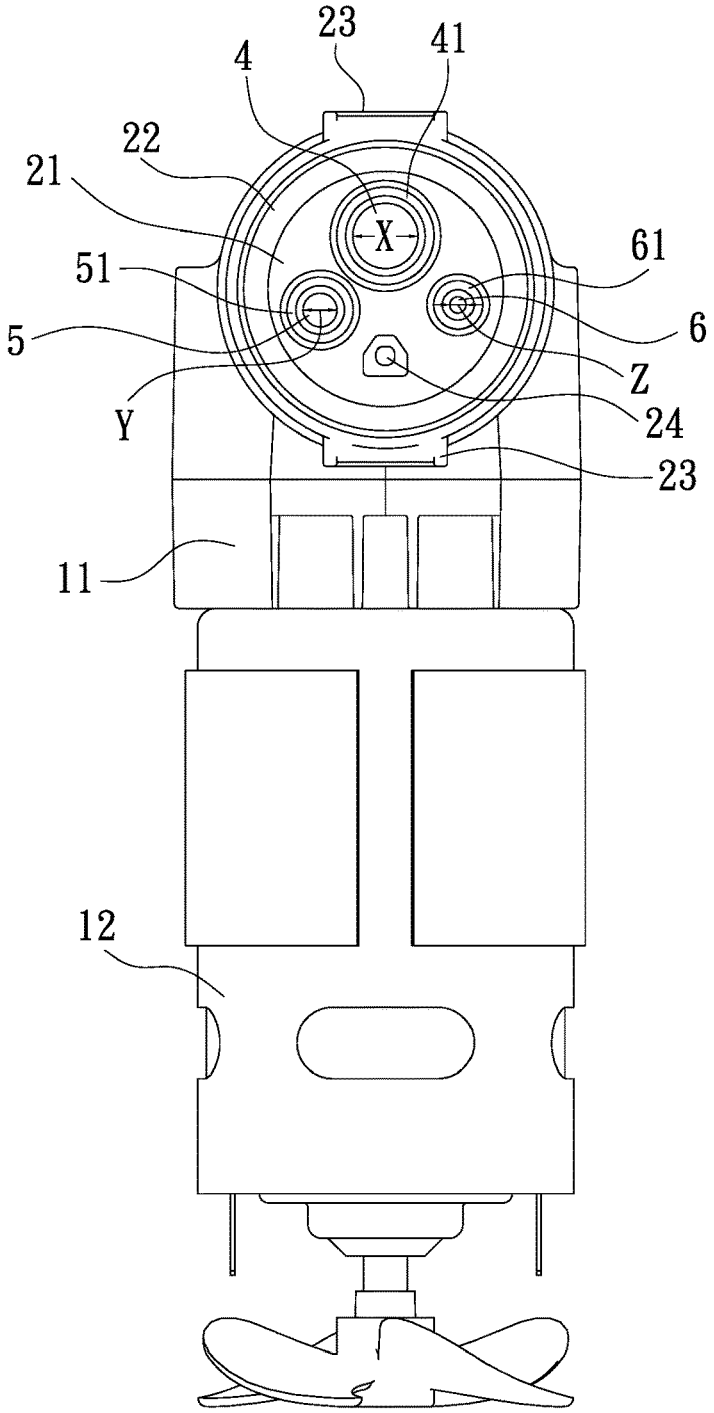
FIG. 3 shows a plan view of the air compressor, wherein a cylinder used in the air compressor defines three exit holes.
Figure 4:
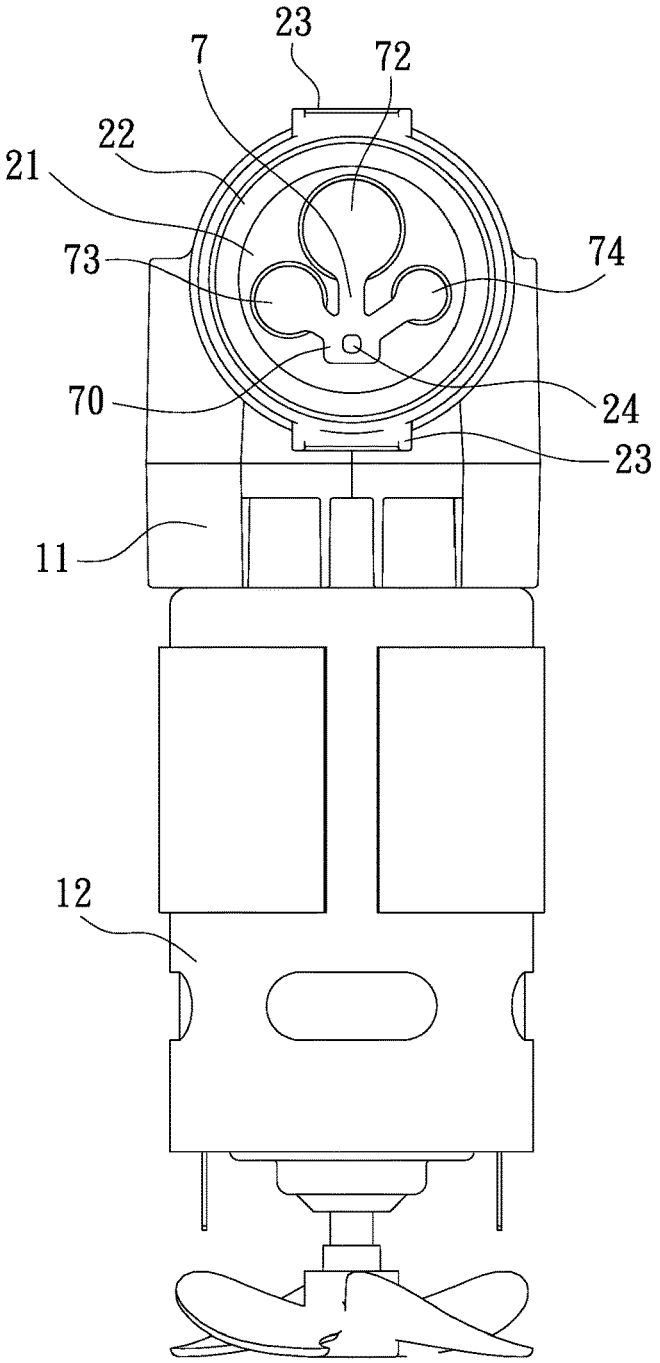
FIG. 4 shows a plan view of the air compressor, wherein three branches of a resilient sheet are respectively placed on the exit holes of the cylinder.
Figure 5:
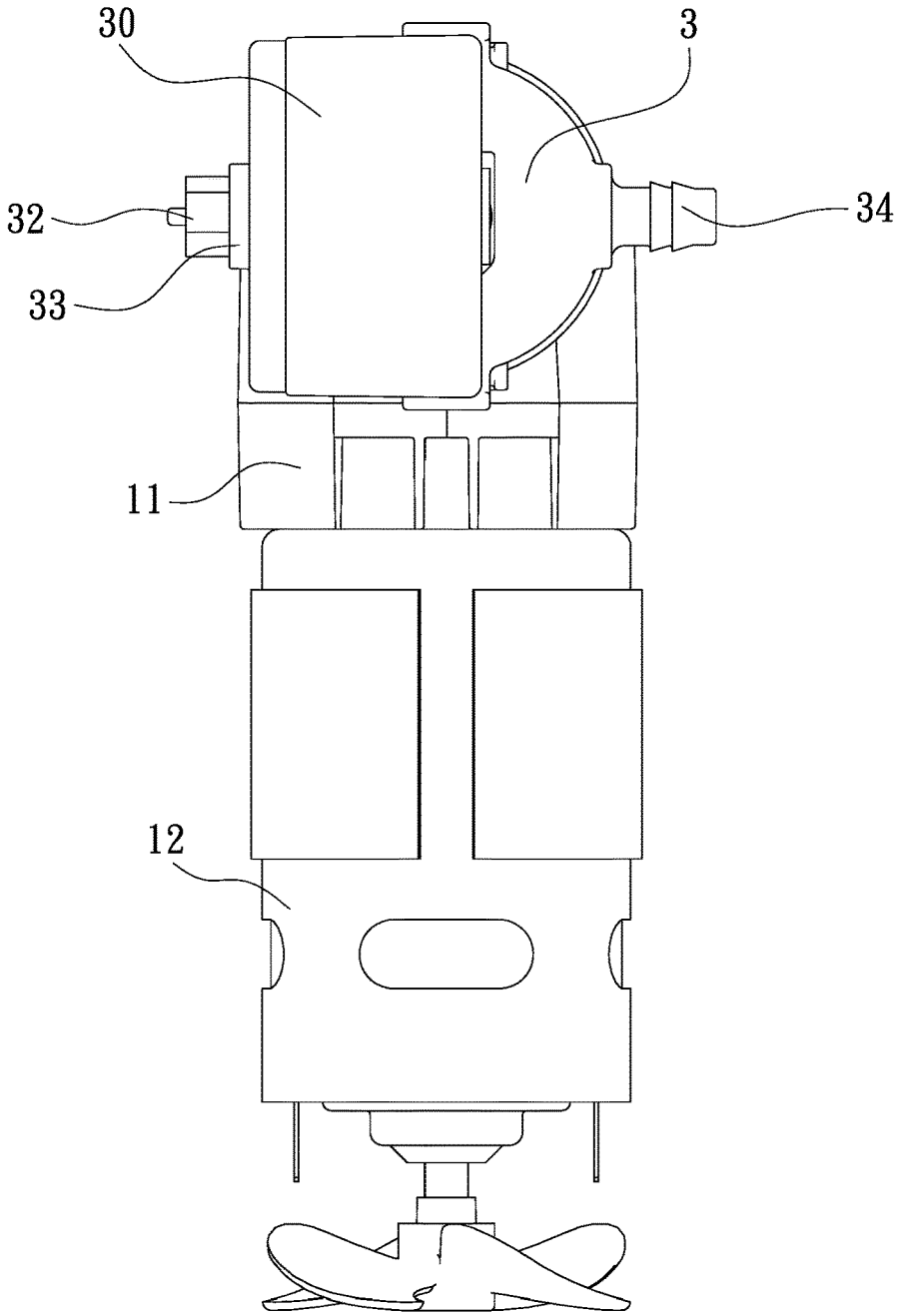
FIG. 5 shows a plan view of the air compressor, wherein an air storage container is mounted to the cylinder.
Figure 8:
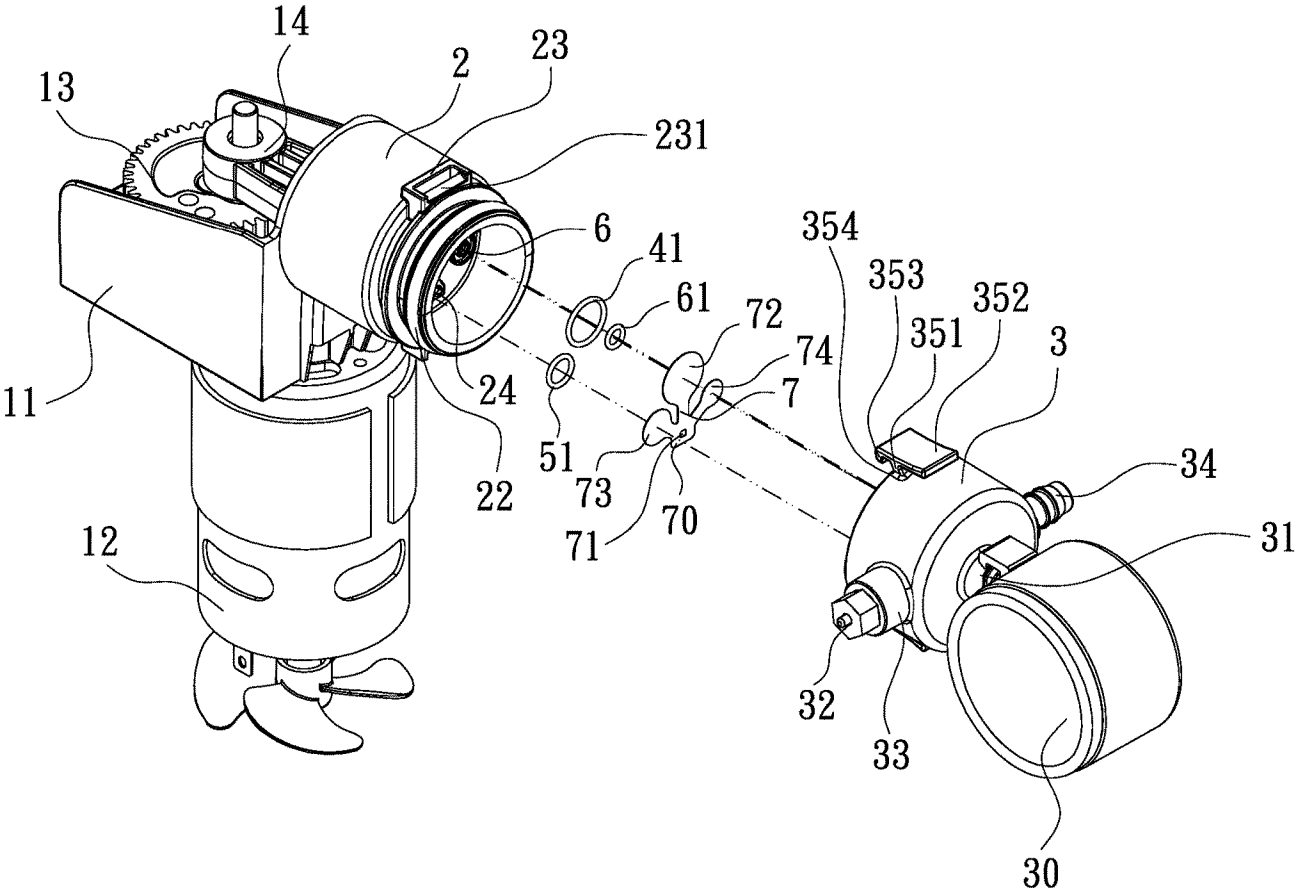
FIG. 8 shows an exploded view of an air compressor according to another embodiment of the present invention, wherein compression springs are not included.

In FIG. 2, although the compression springs 82, 83, 84 are used to urge the branches 72, 73, 74 for sealing the exit holes 4, 5, 6 of the cylinder 2 more quickly, one embodiment can uses a resilient sheet only, without compression springs, to seal the exit holes properly. In FIG. 8, which shows another embodiment of the present invention, since the branches 72, 73, 74 of the resilient sheet 7 embody the function of a compression spring, they can seal the exit holes 4, 5, 6 without the assistance of compression springs.

As a summary, the air compressor of the present invention is featured in that the top wall 21 of the cylinder 2 defines a plurality of exit holes having different diameters. The exit holes can be respectively sealed by a plurality of branches of a resilient sheet. In one embodiment, the exit holes 4, 5, 6 can be sealed by the branches 72, 73, 74 of the resilient sheet 7 with or without the assistance of the compression springs 82, 83, 84. As such, the flow rate of the compressed air entering the inner space 36 of the air storage container 3 can be increased significantly. Besides, the branches 72, 73, 74 are subjected to different back forces, wherein the branch 74 is subjected to a smallest back force as the branch 74 has a smallest area on which the pressure of the compressed air in the air storage container 3 is applied, so that the branch 74 can be moved away from the exit hole 6 more easily than the other branches 72, 73, and thus the compressed air can enter the inner space 36 of the air storage container 3 more easily via the exit hole 6 at a later stage of operation. Consequently, the motion resistance of the piston body 14 can be reduced, and thus the load of the motor can be reduced. Therefore, a lower-power motor can be used in the air compressor to quickly inflate an object. This feature renders the present invention useful and inventive.

I claim:

1. In an air compressor which includes a main frame, a motor mounted at the main frame, a cylinder fitted with a piston body and provided at the main frame, and an air storage container, the motor capable of rotating a gear to have the piston body conduct reciprocating motion in the cylinder to produce therein compressed air which is regulated to enter an inner space of the air storage container; wherein the improvement comprises:

the cylinder defines at its top wall a plurality of exit holes and is provided with a valve mechanism including a resilient sheet and a plurality of O-rings placed on the top wall of the cylinder, respectively around the exit holes of the cylinder, the resilient sheet having a root fixed on the top wall of the cylinder and a plurality of branches extending from the root and corresponding to the exit holes, the branches of the resilient sheet urging the O-rings against the top wall of the cylinder to seal the exit holes respectively when the compressed air does not reach a predetermined pressure.

2. The air compressor of claim 1, wherein the exit holes have different diameters, and each branch of the resilient sheet has a coverage area matching a corresponding exit hole, whereby the compressed air enters the air storage container more easily when a large amount of the compressed air has entered the air storage container.

3. The air compressor of claim 2, wherein the root of the resilient sheet defines a positioning hole such that the resilient sheet is fixed on the top wall of the cylinder by fitting the positioning hole with a positioning pin formed on the top wall of the cylinder.

4. The air compressor of claim 3, wherein the cylinder is provided with a tubular projection on the top wall, the tubular projection having two opposite lugs each having a flat segment; the air storage container is provided at a bottom portion of its circumferential surface with two opposite resilient holders corresponding to the two opposite lugs, each resilient holder having a fulcrum portion, a press portion, a first engagement portion, and a second engagement portion, the fulcrum portion extending outwardly from the bottom portion of the circumferential surface of the air storage container and integrally formed between the press portion and the first engagement portion, the second engagement portion being formed, opposite to the first engagement portion, at one end of the fulcrum portion that joins the circumferential surface of the air storage container, the first engagement portion capable of engaging with one surface of the flat segment of a corresponding lug of the cylinder, the second engagement portion capable of engaging with an opposite surface of the flat segment of the corresponding lug of the cylinder; whereby a user may fit the air storage container over the cylinder to have the two opposite resilient holders snap at the flat segments of the lugs so that the storage container is detachably mounted to the cylinder, and may depress the press portions of the two opposite resilient holders to allow the air storage container to be released from the cylinder.

5. The air compressor of claim 1, further comprising a plurality of compression springs corresponding to and placed on the branches of the resilient sheet respectively to facilitate the branches of the resilient sheet urging the O-rings against the top wall of the cylinder to seal the exit holes respectively when the compressed air does not reach a predetermined pressure.

6. The air compressor of claim 5, wherein the exit holes have different diameters, each branch of the resilient sheet has a coverage area matching a corresponding exit hole, and each compression spring exerts a specific compressive force onto a corresponding branch of the resilient sheet, whereby the compressed air enters the air storage container more easily when a large amount of the compressed air has entered the air storage container.

7. The air compressor of claim 6, wherein the air storage container is provided at its inner surface with a plurality of columns corresponding to the compression springs; a first end of each compression spring is urged against one of the branches of the resilient sheet while a second end of each compression spring is fitted around one of the columns of the air storage container, the columns of the air storage container being respectively located slightly above the branches of the resilient sheet to limit movements of the branches of the resilient sheet.

* * * * *